United States Patent [19]

Kawamura et al.

[11] 4,251,746

[45] Feb. 17, 1981

[54] DIRECT-HEATED CATHODE STRUCTURE

[75] Inventors: Takao Kawamura, Chiba; Yukihiro Izumida, Mobara; Hiroshi Fukushima; Takeo Takemoto, both of Chiba; Masaru Nakazawa, Matsudo; Tetsuo Kumazawa, Ibaraki, all of Japan

[73] Assignee: Hitachi, Ltd., Japan

[21] Appl. No.: 15,620

[22] Filed: Feb. 27, 1979

[30] Foreign Application Priority Data

May 2, 1978 [JP] Japan ..... 53/52926

[51] Int. Cl.[3] ..... H01J 1/14; H01J 19/06; H01K 1/04

[52] U.S. Cl. ..... 313/345; 313/284; 313/341; 313/292

[58] Field of Search ..... 313/346, 337, 341, 270, 313/345, 284, 292

[56] References Cited

U.S. PATENT DOCUMENTS

| | | | |
|---|---|---|---|
| 2,677,778 | 5/1954 | Baker et al. | 313/341 X |
| 3,263,115 | 7/1966 | Glascock, Jr. et al. | 313/337 |
| 3,541,382 | 11/1970 | Takanashi et al. | 313/346 R |
| 4,082,938 | 4/1978 | Shergov et al. | 313/337 |
| 4,129,801 | 12/1978 | Soeno et al. | 313/346 R |
| 4,150,318 | 4/1979 | Kerstetter | 313/346 R |

*Primary Examiner*—Saxfield Chatmon, Jr.

*Attorney, Agent, or Firm*—Craig & Antonelli

[57] ABSTRACT

There is disclosed a direct-heated cathode structure which comprises an insulating substrate; a pair of conductive supporting rods penetrating the substrate in the direction substantially perpendicular to the surface of the substrate and fixed tightly to the substrate; and a conductive member made of a single metal plate and including a first portion which is arranged in a plane spaced apart from the surface of the substrate by a predetermined distance and substantially parallel to the surface of the substrate and is coated with an electron emissive material, second portions which are extended from the first portion in the above-mentioned parallel plane substantially symmetrically with respect to the first portion, third portions which are extended from the end of extension of each of the second portions in the direction substantially perpendicular to the surface of the substrate toward the substrate, and fourth portions which are extended from the ends of the third portions in the direction substantially parallel to the surface of the substrate in the same plane as the third portions and are fixed to the supporting rods in the neighborhood of the end of extension of the fourth portions. Each of the first, second and third portions has a side wall provided along at least a part of the edges of these portions and extending in the direction substantially perpendicular to the surfaces of these portions.

11 Claims, 14 Drawing Figures

DIRECT-HEATED CATHODE STRUCTURE

The present invention relates to a direct-heated cathode structure, and more particularly to the structure of a heat generating body in the direct-heated cathode structure.

The prior art and the present invention and the advantages of the latter will be described in detail with reference to the accompanying drawings, in which.

In general, an electron gun structure for a cathode ray tube includes a cathode structure for emitting electrons, a control electrode for controlling the intensity of the electron beam, a screen electrode, and a group of electrodes for a main electron lens which forms a main electron lens system for focusing the electron beam on a phosphor screen. There have been adopted various shapes for each of the above electrodes, and there also have been adopted constructions of various types for the group of electrodes for the main electron lens.

Figure 1:
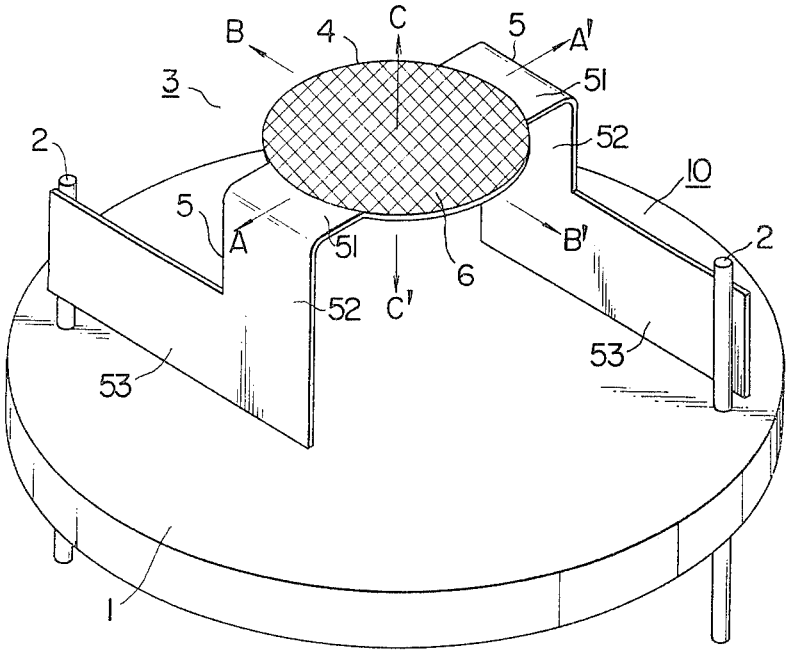
FIG. 1 PRIOR ART
FIG. 1 is a perspective view of a conventional direct-heated cathode structure.

The present invention relates to a direct-heated cathode structure of the type included in the aforementioned electron gun structure. This cathode structure has the very important function of emitting an electron beam. Referring to FIG. 1, an insulating substrate 1 is made of an insulating material, such as ceramic or glass, and a pair of supporting rods 2 are made of a conductive material, such as fernico, which is approximately equal in coefficient of thermal expansion to the substrate 1 and is the most suitable material for the rods 2 carried by the substrate 1. The supporting rods 2 penetrate the substrate 1 perpendicularly to the surface of the substrate 1, and are tightly fixed to the substrate 1. Further, a cathode 3 bridges the supporting rods. The cathode 3 has a heat generating body including a disc portion 4 with its surface approximately parallel to the substrate 1 and a pair of strip leads 5 which have a substantially symmetrical shape with respect to an axis passing through the center of the disc portion 4 perpendicularly to the substrate 1. Each of the strip leads 5 includes a parallel portion 51 which extends in the same plane as the disc portion 4 and is substantially parallel to the substrate 1, a perpendicular portion 52 which extends from one end of the parallel portion 51 at approximately right angles therewith toward the substrate 1, and a horizontal portion 53 which extends in the direction horizontal to substrate 1 in the same plane as the perpendicular portion 52. The horizontal portions 53 are, as shown in FIG. 1, welded to the supporting rods 2, and thus the cathode 3 can be fixed.

The heat generating body is made of, for example, of an alloy in which a small amount of magnesium, zirconium, or the like is added as a cathode activator to a nickel alloy which contains tungsten of about 20–30% to have an appropriate resistance.

Figure 2:
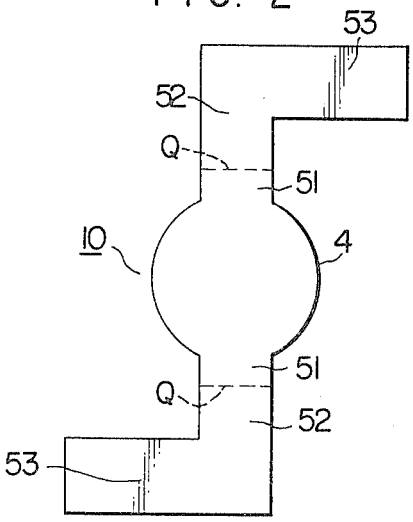
FIG. 2 is a plan view of the heat generating body of the cathode structure shown in FIG. 1 before a bending operation for forming a gate-like shape of the heat generating body is effected.

FIG. 2 is a plan view of the heat generating body before bending occurs along the boundary between the parallel portion 51 and the perpendicular portion 52. The heat generating body 10 is bent along broken lines Q in FIG. 2 into a gate-like shape, as shown in FIG. 1. The cathode 3 has an electron emissive material 6 applied to the surface of the disc portion 4, which material is composed of an electron emissive oxide of, for example, a ternary alkaline-earth metal mixture Ba-Sr-Ca. In operation, the heat generating body performs resistance heating by a current which passes through the heat generating body itself via the two supporting rods 2, and the temperature rises to about 800° C. Thermionic emission from the electron emissive material 6 is stably effected at the above operating temperature.

When the cathode 3 is operated at the operating temperature as above for a long time, the heat generating body 10, specifically, the disc portion 4 is varied in shape or deformed due to thermal stress, diffusion of substance in metal, and the like. There is no problem with a deformation in which the heat generating body 10 is subjected to a displacement in a direction parallel to the surface of the disc portion 4, such as in the direction of arrows A–A′ or B–B′ in FIG. 1, i.e., such a deformation that the disc portion 4 with the electron emissive material 6 is subjected to a parallel displacement in a plane in which the disc portion 4 lies. However, when the disc portion 4 is displaced or deformed in a direction perpendicular to the surface of the disc portion, namely, in the direction of arrows C–C′ in FIG. 1, the electron emission characteristic of the electron gun will be changed. This will be explained below in further detail. In the electron gun structure, the control electrode is arranged facing the disc portion 4 and at a predetermined distance from that surface of the disc portion 4 which is coated with electron emissive material 6. The control electrode has a small aperture of a predetermined diameter to let electrons emitted from the electron emissive material pass through the control electrode. Further, as mentioned previously, the screen electrode and a group of electrodes for constructing the main electron lens are arranged along the axis of the control electrode. In the above construction, a deformation of the heat generating body 10 such that the disc portion 4 is subjected to a parallel dispacement in the same plane as the disc portion does not matter, because the aperture of the control electrode for allowing electrons to pass through the control electrode is far smaller in area than the surface coated with the electron emissive material. However, a deformation of the heat generating body 10 such that the disc portion 4 is displaced in the direction perpendicular to the surface of the disc portion will change the predetermined spacing between the control electrode and the surface coated with the electron emissive material. As a result, there will arise a problem such that the intensity of the electron beam is changed and the cutoff characteristic is deteriorated. Further, in a color television receiver having three direct-heated cathodes in the same electron gun, the cathodes are not always subjected to an equal amount of deformation of the heat generating body 10. Thus, there arises a problem such that the white balance in reproduced picture images may be destroyed due to the above deformation. In constructing the electron gun, the spacing between the control electrode and the disc portion 4 is determined taking into consideration a predictable deformation, such as the thermal expansion of perpendicular portion 52 in the direction indicated by the arrow C. The adjustment of the above-mentioned spacing is made by adjusting the position at which the horizontal portions 53 are welded to the supporting rods 2. However, an unpredictable deformation such as the bend of the disc portion 4, the parallel portions 51, or the perpendicular portions 52 cannot be taken into consideration at the time when the electron gun is constructed.

Figure 3A:
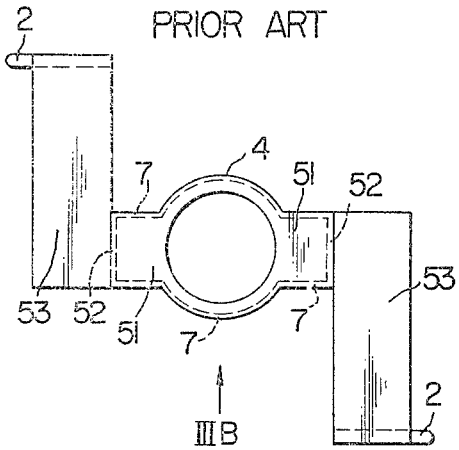
FIG. 3A PRIOR ART
FIG. 3A is a plan view of another conventional direct-heated cathode structure.
Figure 3B:
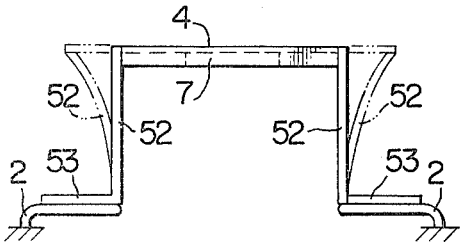
FIG. 3B PRIOR ART
FIG. 3B is an elevational view of the cathode structure shown in FIG. 3A, viewed in the direction indicated by arrow IIIB in FIG. 3A.
Figure 3C:
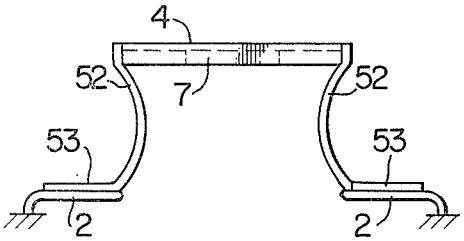
FIG. 3C PRIOR ART
FIG. 3C is an elevational view for explaining a state in which a permanent deformation is produced in a part of the cathode structure shown in FIG. 3A.

To eliminate the above problem, there have been proposed various measures for preventing the deformation of the heat generating body 10, particularly such a deformation as displacing the disc portion 4 in the direction perpendicular to the surface thereof. For example, Japanese patent application Laid-open No. 155957/77 discloses a direct-heated cathode structure in which the horizontal portions 53, the supporting rods 2 and the disc portion 4 are modified in their shapes. Specifically, in the description relating to FIG. 7 of the above Japanese patent application, there is proposed the formation of a side wall at a part of the circumference of the disc portion 4 by bending downward the circumference of the disc portion 4 at right angles to the plane thereof. Further, FIG. 7 of the Japanese Patent application suggests that the above side wall is formed along the whole circumference of the disc portion 4 including the edges of parallel portions 51. FIG. 3A is a plan view of the heat generating body including the disc portion 4 and the parallel portions 51 which have the above-mentioned shapes, and is similar to FIG. 7 of the above Japanese patent application. FIG. 3B is an elevational view of the heat generating body viewed from the arrow IIIB in FIG. 3A. In FIGS. 3A and 3B, similar parts to those in FIG. 1 are indicated by the same reference numerals. The side wall 7 at the circumference of the disc portion 4 and the edges of the parallel portion 51 are provided for preventing the part of the heat generating body 10 made up of the disc portion 4 and the parallel portions 51 from being subjected to a deformation, such as a bend at the operating temperature of the heat generating body of about 800° C. Accordingly, when the temperature of the heat generating body rises to the operating temperature, the disc portion 4 and the parallel portions 51 are expanded in the same plane as these portions. Thus, there can be prevented the displacement of the disc portion 4 in the direction perpendicular to the surface thereof. However, due to the expansion of the disc portion 4 and the parallel portions 51, the perpendicular portions 52 which are made of a flat plate are bent as shown by dot-and-dashed lines in FIG. 3B. When the operation of the cathode 3 terminates, such a deformation of the perpendicular portions 52 disappears due to the compression of the part including the disc portion 4 and the parallel portions 51 which have both been expanded and due to the elasticity of the perpendicular portions 52, and the perpendicular portions 52 return to the original shape. However, if the cathode 3 is repeatedly operated for a long time, the perpendicular portions 52 are subjected to a permanent deformation, and have such a shape as shown in FIG. 3C even when the cathode 3 is not operated. In this case, therefore, the surface of the disc portion 4 is displaced in the direction perpendicular to the surface. That is, the conventional structure shown in FIGS. 3A and 3B is effective in preventing the deformation of the disc portion 4 and the parallel portions 51, but is insufficient to solve the above-mentioned problem. Other embodiments disclosed in the above-mentioned Japanese patent application have the same drawback as mentioned above.

In addition to the above-mentioned Japanese Patent application, there are many patent or utility model applications proposing a solution of the abovementioned problem, which are, for example, Japanese patent applications Laid-open Nos. 155956/77 and 53662/73, and Japanese Utility Model applications Laid-open Nos. 109852/73 and 35952/77.

The object of the present invention is to provide a direct-heated cathode structure having a structure which is simple and easy to construct and capable of suppressing effectively any deformation of the heat generating body that involves the surface coated with electron emissive material being displaced in the direction perpendicular to the surface.

According to one aspect of the present invention, there is provided a direct-heated cathode structure comprising: an insulating substrate; a pair of conductive supporting rods penetrating the substrate in a direction substantially perpendicular to the surface of the substrate and fixed to the substrate; and a conductive member made of a single metal plate and including a first portion arranged in a plane substantially parallel to the surface of the substrate and spaced apart from the surface of the substrate by a predetermined distance, the first portion being coated with an electron emissive material, second portions extended from said first portion in the parallel plane substantially symmetrically with respect to the first portion, third portions extended with a predetermined length from the end of extension of the second portions toward the substrate in the direction substantially perpendicular to the surface of the substrate, and fourth portions extended from the ends of the third portions in the same plane as the third portions in the direction substantially parallel to the surface of the substrate, the fourth portions being fixed to the supporting rods in the neighborhood of the end of extension of the fourth portions; wherein each of the first portion, the second portions and the third portions has a rim member provided along at least a part of edges thereof, the rim menbers having a predetermined height extending in the direction substantially perpendicular to the surfaces of the first, second and third portions, respectively.

According to another aspect of the present invention, there is provided a direct-heated cathode structure comprising: an insulating substrate; a pair of conductive supporting rods penetrating said substrate in the direction substantially perpendicular to the surface of the substrate and fixed to the substrate; and a heat generating body including a conductive plate member on which an electron emissive material is applied, and a pair of conductive strip leads, the plate member being arranged in a plane spaced apart from the surface of the substrate by a predetermined distance and substantially parallel to the surface of the substrate, and having a predetermined contour and side edges, and the pair of strip leads being arranged substantially symmetrically with respect to an axis passing through the center of said plate member in the direction substantially perpendicular to the surface of the substrate, each of the strip leads including a parallel portion extended from the plate member in the same plane as the plate member in parallel with the surface of the substrate and having a predetermined width with side edges, a perpendicular portion extended from the end of extension of the parallel portion in the direction substantially perpendicular to the parallel portion toward the surface of the substrate and having a predetermined width with side edges and a predetermined length, and a horizontal portion extended from the perpendicular portion in the direction substantially parallel to the surface of the substrate in the same plane as the perpendicular portion and having a predetermined width in the direction perpendicular to the surface of the substrate, the horizontal portion being fixed to the supporting rod in the neighborhood of the end of extension of the horizontal portion; wherein the plate member and the parallel portions have a first side wall extending from the side edges of the plate member and the parallel portions in the direction substantially perpendicular to the surfaces of the plate member and the parallel portions and having a predetermined height, and the perpendicular portions have, along at least a part of the predetermined length, a second sidewall extending from the side edges of the perpendicular portions in the direction substantially perpendicular to the surfaces of the perpendicular portions and having a predetermined height.

The feature of the present invention resides in that the gate-like-shaped part of the heat generating body 10, which comprises the disc portion 4, the parallel portions 51 and the perpendicular portions 52, is prevented from being deformed in the direction indicated by the arrows C–C′ in FIG. 1, and in that the horizontal portions 53 made of a flat plate absorb the deformation of the gate-like-shaped part in the direction indicated by the arrows A–A′ due to thermal expansion. The above-mentioned feature of the present invention is quite different from that proposed in each of the above-mentioned patent applications and utility model applications.

The present invention will be explained hereinafter with reference to FIGS. 4 through 8.

Figure 4:
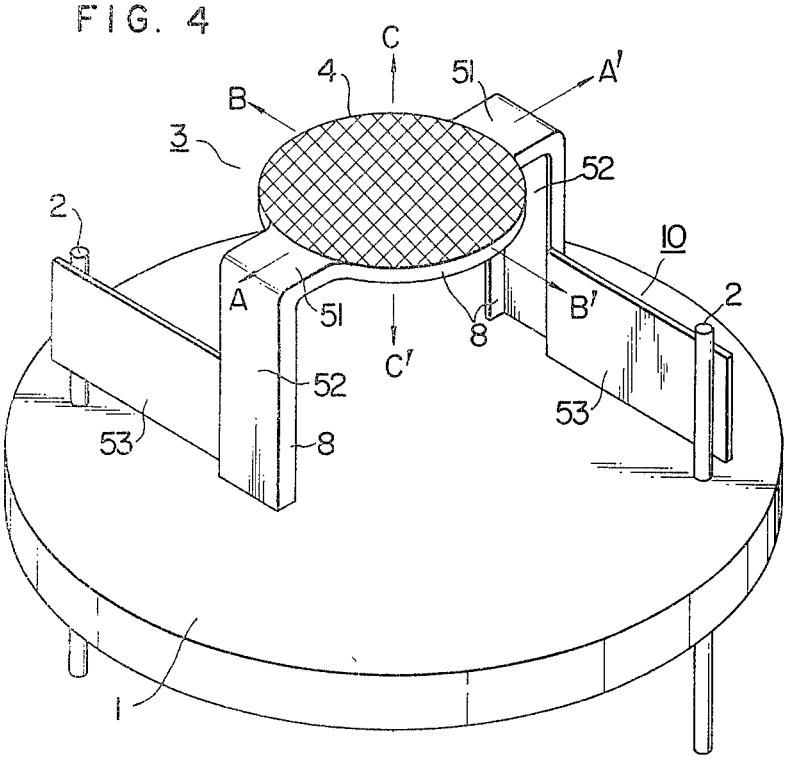
FIG. 4 is a perspective view of a direct-heated cathode structure according to an embodiment of the present invention.
Figure 5A:
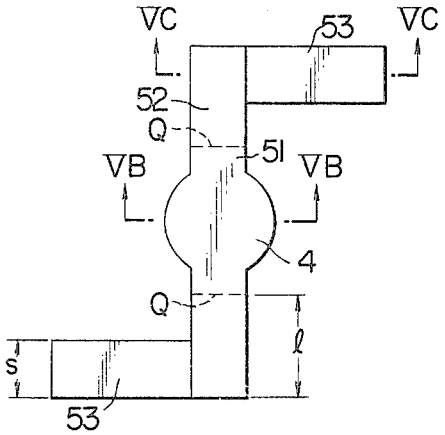
FIG. 5A is a plan view of the heat generating body of the cathode structure shown in FIG. 4 before a bending operation for forming a gate-like shape of the heat generating body is effected.
Figure 5B:
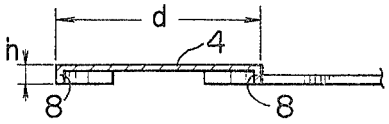
FIG. 5B is an enlarged sectional view of the heat generating body, taken along the line VB—VB of FIG. 5A.
Figure 5C:
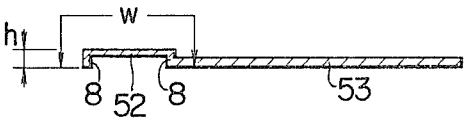
FIG. 5C is an enlarged sectional view of the heat generating body, taken along the line VC—VC of FIG. 5A.

FIG. 4 is a perspective view of a direct-heated cathode structure according to an embodiment of the present invention. In FIG. 4, the same reference numerals are given to the same parts as in FIG. 1. FIG. 5A is a plan view of the heat generating body shown in FIG. 4 before the heat generating body is bent along the boundaries between parallel portions 51 and perpendicular portions 52, and FIGS. 5B and 5C are enlarged sectional views of the heat generating body taken along lines VB—VB and VC—VC in FIG. 5A, respectively. In the above embodiment, there is provided a rim member or a side wall 8 which is extended from edges of each of the disc portion 4, the parallel portions 51 and the perpendicular portions 52 at approximately right angles to the surface of these portions. The heat generating body is made of a plate of nickel alloy having a thickness of about 40 μm. The disc portion 4, the parallel portions 51, the perpendicular portions 52, the horizontal portion 53 and the side wall 8 are all formed through a press working. The disc portion 4 has a diameter of about 1.2 mm, the parallel portions 51 and the perpendicular portions 52 are about 0.5 to 0.7 mm in expansion width w, and the side wall 8 has a height of about 0.1 mm. Further, the perpendicular portions 52 are about 0.9 mm in length l, and the horizontal portions 53 are about 0.7 mm in width s. Broken lines Q in FIG. 5A indicate the boundaries between the parallel portions 51 and the perpendicular portions 52. The heat generating body is bent along the broken lines Q into the form of a gate-like shape as shown in FIG. 4.

In the cathode structure formed as above, although, in operation, the heat generating body 10 is subjected to a thermal deformation, the part of the heat generating body 10 which includes the disc portion 4 and the parallel portions 51 is scarcely deformed in the direction perpendicular to the surface of the disc portion 4, but rather is thermally expanded in the plane containing the disc portion 4, because both of the disc portion 4 and the parallel portions 51 have the side wall 8. Since, in this embodiment, the perpendicular portions 52 also have the side wall 8, even when there is produced, due to the thermal expansion of the disc portion 4 and the parallel portions 51, a force by which the distance between the pair of the perpendicular portions 52 is enlarged, that is, a force having the direction indicated by the arrows A–A′ perpendicular portions 52 are not subjected to a bend such as explained with reference to FIG. 3B, but are displaced substantially parallel to the surface of the substrate 1. Since the horizontal portion 53 is made of a flat plate, it is bent according to the parallel displacement of the perpendicular portion 52 with its end at which the horizontal portion 53 is welded to the supporting rod 2 being a fixed point. In other words, the thermal expansion of the disc portion 4 and the parallel portions 51 is absorbed by the horizontal portions 53. In operation, the horizontal portions 53 are also thermally expanded in the longitudinal direction, namely in the direction indicated by the arrows B–B′. However, the above expansion of the horizontal portions 53 only turns the gate-like-shaped portion including the disc portion 4, the parallel portions 51 and the perpendicular portions 52, round the axis passing through the center of the disc portion 4 and perpendicular to the surface of the disc portion 4, but does not have an affect such that the disc portion 4 is displaced in the direction of the arrows C–C′. Owing to the repeated operation of the cathode 3, the horizontal portions will be subjected to a permanent deformation, as has been explained with respect to the perpendicular portions 52 in FIG. 3C. However, such a permanent deformation only produces a displacement of the gate-like-shaped portion in the direction A–A′ and/or B–B′. The disc portion 4 will be displaced in the direction indicated by the arrow C due to the thermal expansion of the perpendicular portions 52. However, as mentioned previously, in constructing the electron gun, the spacing between the control electrode and the disc portion 4 is determined taking the above thermal expansion into consideration. Therefore, the thermal expansion of the perpendicular portions 52 does not relate to the problem that the intensity of electron beam is varied.

Figure 6:
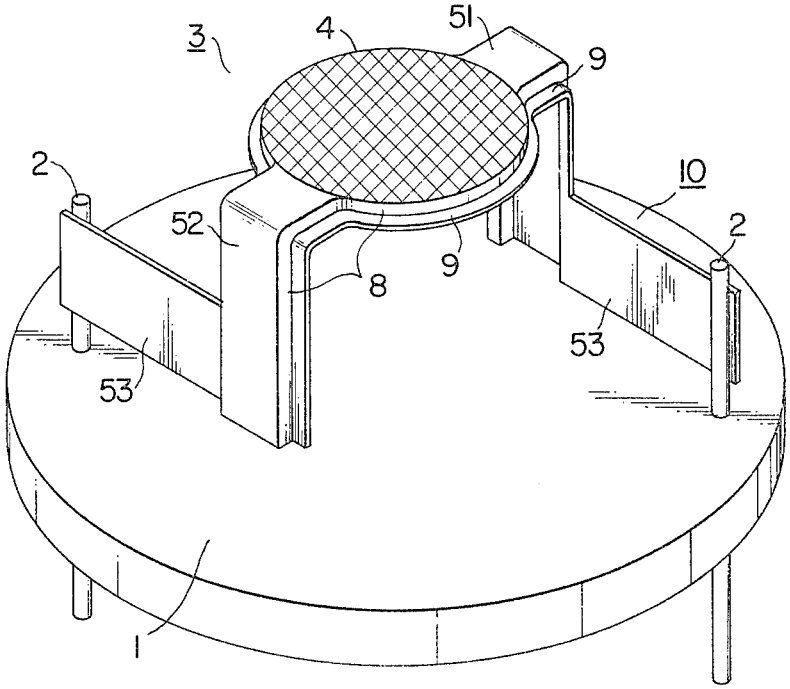
FIG. 6 is a perspective view of a directheated cathode structure according to another embodiment of the present invention.
Figure 7A:
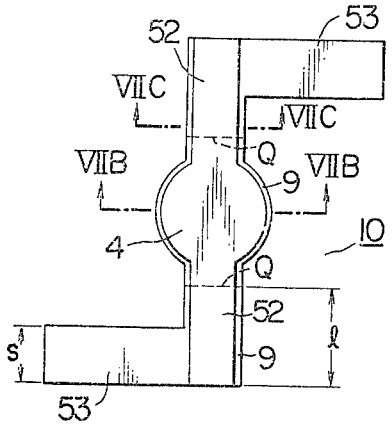
FIG. 7A is a plan view of the heat generating body of the cathode structure shown in FIG. 6 before a bending operation for forming a gate-like shape of the heat generating body is effected.
Figure 7B:
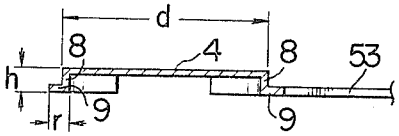
FIG. 7B is an enlarged sectional view of the heat generating body, taken along the line VIIB—VIIB of FIG. 7A.
Figure 7C:
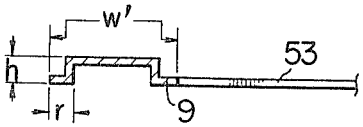
FIG. 7C is an enlarged sectional view of the heat generating body, taken along the line VIIC—VIIC of FIG. 7A.

FIG. 6 shows another embodiment of the present invention. In FIG. 6, the same reference numerals are given to the same parts as in FIG. 4. FIG. 7A is a plan view of the heat generating body 10 shown in FIG. 6 before the heat generating body is bent along the boundaries between parallel portions 51 and perpendicular portions 52. FIGS. 7B and 7C are enlarged sectional views taken along the lines VIIB—VIIB and VIIC—VIIC in FIG. 7A, respectively. In this embodiment, there is provided a flange 9 which is extended from the edge of the side wall 8 in the direction perpendicular to the side wall. The side wall 8 is reinforced by the flange 9, and therefore the gate-like-shaped portion including the disc portion 4, the parallel portions 51 and the perpendicular portions 52 is more reinforced against its thermal deformation. Thus, a deformation such as a bend of the whole or a part of the gate-like-shaped portion is more effectively prevented. Further, the addition of the flange 9 is favorable for the formation of the side wall 8 from the standpoint of operation in press working. The heat generating body 10 according to this embodiment can also be made of a nickel alloy plate having a thickness of about 40 μm through a press working, and the flange 9 is about 0.1 mm in width r. The expansion width w′ of the parallel portions 51 and the perpendicular portions 52 including the flange 9 is preferably made approximately equal to the width s of the horizontal portions 53 to avoid uneven heating in the strip leads. Broken lines Q in FIG. 7A show the boundaries between the parallel portions 51 and the perpendicular portions 52. The gate-like shape of the heat generating body shown in FIG. 6 is formed by bending the heat generating body in FIG. 7A along the broken lines Q.

For the cathode structure according to the above embodiment of FIG. 6, a life test of one thousand hours was carried out, and it was found that the displacement of the disc portion 4 in the direction perpendicular to the surface thereof was about 1 μm. A similar test conducted for the conventional cathode structure shown in FIG. 1 indicated that the above-mentioned displacement was about 10 μm. Therefore, the present invention can reduce largely a deformation of the cathode structure such as adversely affecting the intensity of electron beam emitted from the electron gun.

Figure 8:
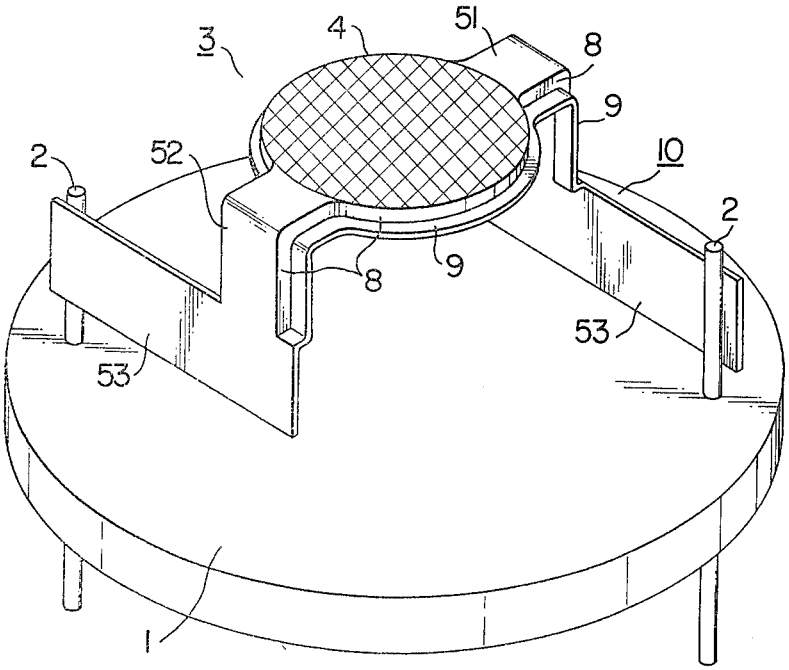
FIG. 8 is a perspective view of a direct-heated cathode structure according to a further embodiment of the present invention.

Although, in the embodiments shown in FIGS. 4 and 6, the side wall 8 or the combination of the side wall 8 and the flange 9 is provided over the total length l of each of the perpendicular portions 52, the structure shown in FIG. 8 in which the side wall 8 and the flange 9 are provided in a part of the total length of each of the perpendicular portions 52, can also produce substantially the same effect as in the embodiments of FIGS. 4 and 6. However, in order to obtain a desirable effect in the structure shown in FIG. 8, it is preferable that the side wall 8 or the combination of the side wall 8 and the flange 9 is provided over a predetermined length, preferably the length of l-s, from the boundary between the parallel portion 51 and the perpendicular portion 52.

It should be understood that the size, shape and fabrication method of each of the side wall 8 and the flange 9 are not limited to those described and depicted herein, but various modification can be made within the scope of the present invention.

What we claim is:

1. A direct-heated cathode structure comprising:

an insulating substrate;

a pair of conductive supporting rods penetrating said substrate in the direction substantially perpendicular to the surface of said substrate and fixed to said substrate; and a conductive member made of a single metal plate and including a first portion arranged in a plane substantially parallel to the surface of said substrate and spaced from the surface of said substrate by a predetermined distance, at least a part of said first portion being coated with an electron emissive material, second portions extended from said first portion in said parallel plane substantially symmetrically with respect to said first portion, third portions extended with a predetermined length from the end of extension of respective second portions toward said substrate in the direction substantially perpendicular to the surface of said substrate, and fourth portions extended from the ends of said third portions in the same plane as said third portions in the direction substantially parallel to the surface of said substrate, said fourth portions being fixed to said supporting rods in the neighborhood of the end of extension of said fourth portions;

wherein each of said first portion, said second portions and said third portions has a rim member provided along at least a part of edges thereof, said rim members having a predetermined height extending in the direction substantially perpendicular to the surfaces of said first, second and third portions, respectively.

2. A direct-heated cathode structure according to claim 1, wherein said rim members of said first, second, and third portions are formed integrally with one another and with said first, second, and third portions.

3. A direct-heated cathode structure according to claim 1, wherein said rim members are provided along the full extent of the edges of said first, second, and third portions.

4. A direct-heated cathode structure according to claim 1, wherein said rim members are provided along the full extent of the edges of said first and second portions and along a part of the edge of said third portions.

5. A direct-heated cathode structure according to claim 1, 2, 3, or 4, wherein said rim members are side walls provided by bending parts of said single metal plate along lines corresponding to said edges.

6. A direct-heated cathode structure according to claim 5, wherein said side walls have flanges extending from the end of the height of said side walls in the direction substantially perpendicular to the surfaces of said side walls.

7. A direct-heated cathode structure according to claim 6, wherein said flanges are provided by parts of said single metal plate bent along a line corresponding to the end of the height of said side walls.

8. A direct-heated cathode structure comprising:

an insulating substrate;

a pair of conductive supporting rods penetrating said substrate in the direction substantially perpendicular to the surface of said substrate and fixed to said substrate; and a heat generating body including a conductive plate member on which an electron emissive material is applied and a pair of conductive strip leads, said plate member being arranged in a plane spaced from the surface of said substrate by a predetermined distance and being substantially parallel to the surface of said substrate, and having a predetermined contour and side edges, and said pair of strip leads being arranged substantially symmetrically with respect to an axis passing through the center of said plate member in the direction substantially perpendicular to the surface of said substrate, each of said strip leads including a parallel portion extended from said plate member in the same plane as said plate member in parallel with the surface of said substrate and having a predetermined width with side edges, a perpendicular portion extended from the end of extension of said parallel portion in the direction substantially perpendicular to said parallel portion toward the surface of said substrate and having a predetermined width with side edges and a predetermined length, and a horizontal portion extended from said perpendicular portion in the direction substantially parallel to the surface of said substrate in the same plane as said perpendicular portion and having a predetermined width in the direction perpendicular to the surface of said substrate, said horizontal portion being fixed to said supporting rod in the neighborhood of the end of extension of said horizontal portion;

wherein said plate member and said parallel portions have a first side wall extending from said side edges of said plate member and said parallel portions in the direction substantially perpendicular to the surfaces of said plate member and said parallel portions and having a predetermined height, and said perpendicular portions have, along at least a part of said predetermined length, a second side wall extending from said side edges of said perpendicular portions in the direction substantially perpendicular to the surfaces of said perpendicular portions and having a predetermined height.

9. A direct-heated cathode structure according to claim 8, wherein said second side wall is provided over the full extent of said predetermined length.

10. A direct-heated cathode structure according to claim 8, wherein said first and second side walls have flanges extending from the end of the height of said side walls in the direction substantially perpendicular to the surfaces of said side walls.

11. A direct-heated cathode structure according to claim 10, wherein said heat generating body, said first and second side walls and said flanges are formed integrally with one another from a single metal plate.

* * * * *